US009593006B2

(12) United States Patent
Weepie

(10) Patent No.: US 9,593,006 B2
(45) Date of Patent: Mar. 14, 2017

(54) NOZZLE CONSTRUCTION TO FACILITATE ITS OPENING AND ENHANCE THE FLOW OF FUEL THROUGH THE NOZZLE

(71) Applicant: Keith J. Weepie, Marthasville, MO (US)

(72) Inventor: Keith J. Weepie, Marthasville, MO (US)

(73) Assignee: Husky Corporation, Pacific, MO (US)

( * ) Notice: Subject to any disclaimer, the term of this patent is extended or adjusted under 35 U.S.C. 154(b) by 43 days.

(21) Appl. No.: 14/545,456

(22) Filed: May 6, 2015

(65) Prior Publication Data

US 2015/0321898 A1 Nov. 12, 2015

Related U.S. Application Data

(60) Provisional application No. 61/996,431, filed on May 7, 2014.

(51) Int. Cl.

| | |
|---|---|
| ***B67D 7/46*** | (2010.01) |
| ***B67D 7/44*** | (2010.01) |
| ***B67D 7/04*** | (2010.01) |
| ***B67D 7/42*** | (2010.01) |

(52) U.S. Cl.

CPC ..... *B67D 7/44* (2013.01); *B67D 7/04* (2013.01); *B67D 7/42* (2013.01); *B67D 7/46* (2013.01)

(58) Field of Classification Search

CPC ... B67D 7/04; B67D 7/42; B67D 7/44; B67D 7/46; B67D 7/48

USPC ..... 141/59, 206, 311 R, 387, 392

See application file for complete search history.

(56) References Cited

U.S. PATENT DOCUMENTS

| | | | | |
|---|---|---|---|---|
| 2,311,292 | A * | 2/1943 | Eilers | B67D 7/42 251/50 |
| 2,336,473 | A * | 12/1943 | Eilers | B67D 7/04 137/522 |
| 4,016,910 | A | 4/1977 | Dumpis et al. | |
| 4,031,930 | A | 6/1977 | Sutcliffe et al. | |
| 4,331,190 | A | 5/1982 | Sutcliffe et al. | |
| 4,397,447 | A | 8/1983 | Fink, Jr. | |
| 4,559,982 | A | 12/1985 | Fink, Jr. | |
| 4,596,278 | A | 6/1986 | Fink, Jr. | |
| 4,658,987 | A | 4/1987 | Fink, Jr. | |
| 4,825,916 | A | 5/1989 | Fink, Jr. | |
| 4,993,460 | A | 2/1991 | Robinson et al. | |
| 5,085,258 | A | 2/1992 | Fink, Jr. et al. | |
| 5,394,909 | A | 3/1995 | Mitchell et al. | |

(Continued)

*Primary Examiner* — Timothy L Maust
*Assistant Examiner* — Andrew Schmid
(74) *Attorney, Agent, or Firm* — Paul M. Denk

(57) ABSTRACT

A fuel dispensing nozzle, incorporating a uniquely shaped gasket for the poppet valve, generally of truncated shape, enhances the flow of fuel through the nozzle when actuated. A handle lever for the nozzle, which is designed having an elongated and enlarged end, includes elongated slots, that are pivotally pinned through both the latch plate, and the handle link, in order to reduce the space between the interconnection between the front of the latch plate to the bottom of the automatic shutoff stem, such that by lessening the distance between these components, thereby reducing the fulcrum point for the calculation of the force necessary to open the nozzle by raising its handle lever, and reduces the force necessary to achieve nozzle opening and actuation, to less than 5 lbs pressure during usage and application.

4 Claims, 4 Drawing Sheets

(56) References Cited

U.S. PATENT DOCUMENTS

| | | | | |
|---|---|---|---|---|
| 5,474,115 | A | 12/1995 | Fink, Jr. | |
| 5,549,132 | A * | 8/1996 | Butterfield | B67D 7/42 137/270 |
| 5,832,970 | A * | 11/1998 | Carow | B67D 7/48 141/206 |
| 6,585,014 | B1 | 7/2003 | Fink, Jr. | |
| 6,634,395 | B1 | 10/2003 | Mitchell | |
| 7,406,988 | B2 | 8/2008 | Mitchell | |
| 8,186,084 | B2 | 5/2012 | Brown | |
| 8,251,084 | B2 | 8/2012 | Brown | |

* cited by examiner

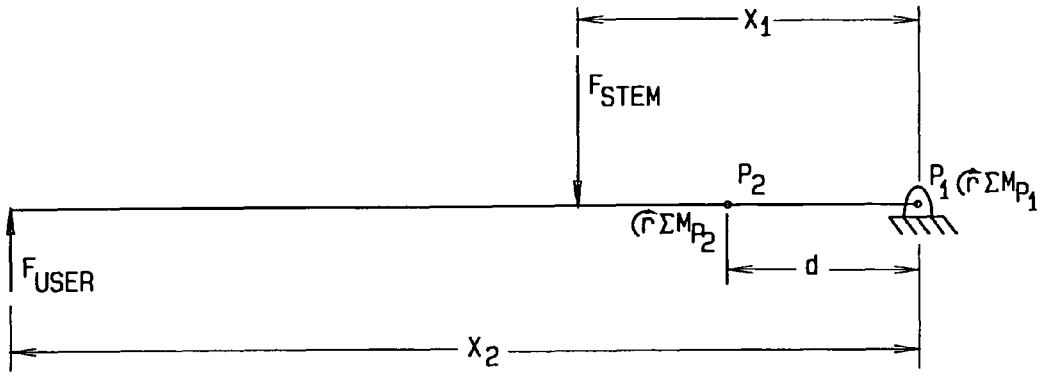

d = PIVOT SHIFT
THE CURRENT DESIGN INVOLVES ONLY $P_1$, $X_1$, $X_2$ $F_{STEM}$, & $F_{USER}$

SUMMATION OF MOMENTS ABOUT $P_1$ TO BREAK STATIC EQUILIBRIUM $$(\circlearrowleft \Sigma M_{P_1} = 0 \therefore \; F_{USER} \times X_2 - F_{STEM} \times X_1 = 0 \Rightarrow F_{USER}^{CURRENT} = \frac{X_1}{X_2} F_{STEM}$$

MOVING THE FORCE CONTROL TO PIVOT P INVOLVES ONLY
$P_2$, d, $X_1$, $X_2$, $F_{STEM}$, & $F_{USER}$

SUMMATION OF MOMENTS ABOUT $P_1$ TO BREAK STATIC EQUILIBRIUM $$(\circlearrowleft \Sigma M_{P_1} = 0 \therefore F_{USER} \times (X_2 - d) - F_{STEM} \times (X_1 - d) = 0 \Rightarrow F_{USER}^{EZ} = \frac{(X_1 - d)}{(X_2 - d)} F_{STEM}$$

PERCENT REDUCTION IN FORCE EXPERIENCED BY THE USER ID $F^{EX}_{USER}$
DIVIDED BY $F^{CURRENT}_{USER}$ $$\% \text{ RED} = \frac{(X_1 - d)}{(X_2 - d)} F_{STEM} \times \frac{X_2}{X_1} F_{STEM} = \frac{(X_1 - d)}{(X_2 - d)} \times \frac{X_2}{X_1}$$

EXAMPLE AS DESIGNED FOR THE EZ LEVER: $X_1 = 1.17$, $X_2 = 5.31$, $d = .65$
% FORCE REDUCTION = (1.17 - .65)*5.31/((5.31 - .65)*1.17) = 50.5%
THAT IS A 50.5% REDUCTION IN THE FORCE REQUIRED TO OPEN THE POPPET.

FIG. 8

NOZZLE CONSTRUCTION TO FACILITATE ITS OPENING AND ENHANCE THE FLOW OF FUEL THROUGH THE NOZZLE

CROSS REFERENCE TO RELATED APPLICATION

This regular letters patent application claims priority to the provisional application having Ser. No. 61/996,431, filed on May 7, 2014.

FIELD OF THE INVENTION

The concept of this invention is to provide, generally, a nozzle, where its poppet valve is contoured into a truncated shape to enhance the flow of fuel through the nozzle as it is dispensing the same, and having a shift in the fulcrum point of the handle lever to lessen the force necessary to open the nozzle poppet valve for dispensing of fuel.

BACKGROUND OF THE INVENTION

A variety of nozzles have been designed over the years wherein their structure has been improved to add to the convenience of usage of the nozzles while dispensing fuel to a vehicle, or other fuel container, and while generally being applied to recover vapors, so as to minimize air pollution during fuel dispensing. With these types of nozzles, whether it is of the vacuum assist type, and more particularly the balanced pressure type of nozzle, the amount of pressure and force necessary to operate the nozzles generally was ignored, in order to attain these other results.

The assignee of the current invention has made many improvements to nozzle constructions, through usage of the hand lever for acting in conjunction with the stem of the poppet valve, to elevate it to achieve fuel dispensing, and at the same time, provide for automatic shutoff of the flow of fuel through the nozzle, through the operations of its vacuum pressured automatic shutoff means, that would release the hand lever for its disengagement allowing for the poppet valve to immediately close, and cease the transfer of fuel through the nozzle. Such can be seen in the Company's early U.S. Pat. No. 4,658,987, upon a No Pressure Shut off for Automatic Fuel Nozzle Valve.

Other patents of the assignee have tried to make improvements to the structure of the nozzle, such as can be seen in the Poppet Valve Means of U.S. Pat. No. 4,397,447. In addition, U.S. Pat. No. 4,596,278 shows a Balanced, Two-Stage Poppet Valve for Fuel Dispensing Nozzle. While these nozzles worked highly satisfactory for their intended purposes, and that is to dispense fuel quickly and efficiently, the structure of the shown handle lever for the disclosed patent still required a fair amount of force to be exerted upon the lever, to raise it, and its associated poppet stem, to attain an opening of the nozzle for dispensing. This type of force made it rather difficult for the handicapped and elderly to dispense fuel, particularly at a self-serving dispenser, and it required further modifications to the nozzle, to remedy this problem.

The U.S. Pat. No. 5,394,909, upon a Vapor Control Valve, showed further modifications to the structure of its nozzle, and its various operating components, to achieve more efficient fuel dispensing, and also for capturing vapors that are returned through the nozzle to a storage area.

U.S. Pat. No. 5,474,115 shows a Specialty Fuel Dispensing Nozzle, of the balance pressure type, and it also required a substantial amount of force on behalf of the user, for inserting and compressing the bellows of the nozzle tightly against the fuel intake for a vehicle in which the nozzle was used, to capture vapors, and to replenish the auto with fuel. Furthermore, it required a fair amount of force, generally in the 8-10 lb range, to lift the hand lever, to initiate the operations of the nozzle, during a refueling operation.

Another patent to the assignee is U.S. Pat. No. 4,016,910, which showed a Fuel Dispensing Nozzle with Automatic Shut-Off Responsive to Vapor Pressure. In addition, U.S. Pat. No. 4,031,930, discloses an early Automatic Shut-Off Nozzle with Lockable Vapor Relief Valve.

U.S. Pat. No. 6,585,014 shows an early effort by the applicant to make it more easier and controllable to dispense fuel through a nozzle, wherein the engagement of the handle with the poppet valve stem was designed to provide the user with more leverage to open the valve assembly than was available at that time in conventional nozzle configurations. This was an early effort to rearrange the fulcrum of pressure exerted upon the poppet stem, through the handle, in order to reduce the force necessary to raise it and its poppet valve into a fuel dispensing position.

The current invention is designed to even further adjust the arrangement and configuration of various components of the nozzle, such as its poppet stem, its handle lever, and its latch plate, all in an effort to further reduce the force necessary to allow for fuel dispensing, and also, provides for further modifications to the poppet valve itself, in order to enhance and accelerate the flow of fuel through the nozzle, when replenishing a vehicle fuel tank, and to make the nozzle more easy to use.

SUMMARY OF THE INVENTION

The concept of this invention is to provide for modifications to the operative components of a fuel dispensing nozzle, particularly with respect to the enhanced flow of fuel through the nozzle, and its poppet valve, and at the same time, furnishing means for lessening the pressure required to lift the poppet valve from its valve seat, requiring a much lesser force, to ease the use and operation of the nozzle, while dispensing fuel, particularly at a self-service dispenser. The first aspect of the improvements to the nozzle, is achieved through the use of a truncated poppet valve, one which when opened provides a greater space through which the fuel may flow, unobstructedly, to provide for a more rapid fill-up of the vehicle fuel tank, during dispensing. The second concept of the invention is to shift the fulcrum point at which the hand lever engages the bottom of the poppet stem, of the same poppet valve, to a position where greater leverage can be attained, thereby lessening the force required to open the poppet valve, in initiating fuel flow.

As known, the handle lever that is manipulated by the nozzle user has a particular configuration that allows for its convenient grasping of its handle portion, and then has a turned segment that locates at a position between the poppet stem, and the automatic shutoff valve stem, in order to add some shiftability to the relationship between the end of the handle lever, and the latch plate to which it pivotally and shiftably mounts. To achieve such, the end of the hand lever incorporates a slotted configuration, through which the latch plate is pinned, so that the latch plate can shift somewhat vertically relative to the hand lever operative end, to add greater flexibility to the functional operation of the hand lever, and its operative components, in cooperating with the poppet stem, and the automatic shutoff means, during usage and application. A handle link also pivotally mounts to the hand lever, at a rearward position from the poppet stem, and further pivotally mounts to the same pin that secures the latch plate to the slotted portion of the hand lever, forwardly of the poppet stem, and through that arrangement, is designed to shift the fulcrum point of the operations of the hand lever, from their connection with the lower end of the automatic shutoff means, and thus, by shortening of the fulcrum point of their operations provides greater leverage to lifting of the poppet stem upwardly, into a opened position, in preparing the nozzle for dispensing. In doing such, the force required to lift the handle lever, because of the greater leverage it attains, through the interconnection of these components, lessens the force necessary to lift the poppet stem into its opened position, in preparation for and during fuel dispensing. In doing such, the normal force for opening of the poppet stem, through lifting of the hand lever, which was in the vicinity of 8-10 lbs, as aforesaid, has been reduced to a force less than 5 lbs of pressure, necessary to manipulate the nozzle into an opened condition. This lessening of force reduces the effort that must be used by those of weaker capacity, such as the elderly, the handicapped, the youth, the female, where a reduction in force facilitates their self-delivery of fuel through the nozzle during dispensing.

In fact, calculations can provide for an indication of the reduction in force that can be attained through usage of the nozzle of this design, as can be seen from the following schematic chart, and the formula calculations, that can be determined mathematically, as noted. The chart, its parameters, and the calculations that may be made through the following formula can show the lesser force required through usage of the nozzle of this invention, during application.

As can be noted in FIG. 8 of the drawings, these various formula and calculations for determining the lesser force required through usage of the nozzle of this invention, are set forth. Through these, and upon review of the schematic chart disclosed therein, this provides a mathematical determination to the reduction of force required to use the nozzle of this design.

As can be noted, from the calculations as determined, for the shifting of the focal point of the hand lever during its usage, in elevating the poppet stem into an opened position, there is a determined percentage of force reduction equal to about 50.5%, required to open the poppet valve, through the upward manipulation of its stem, when initiating the operations of the fuel dispensing nozzle.

It is, therefore, the principal object of this invention to provide means for enhancing the flow of fuel through a nozzle, through the use of a truncated or sloped poppet valve, to provide a greater opening capacity for the poppet, within the nozzle, to achieve greater fuel flow.

It is a further object of this invention to provide a structural reshifting of various components of the nozzle, particularly the interrelationship between the nozzle hand lever, and its location and operation between the poppet stem, and the bottom of the automatic shutoff means, in order to achieve a significant reduction in the amount of force necessary to lift the poppet valve into an opened configuration, to achieve that accelerated fuel flow.

These and other objects may become more apparent to those skilled in the art upon review of the summary of the invention as provided herein, and upon undertaking a study of the description of its preferred embodiment, in view of the drawings.

BRIEF DESCRIPTION OF THE DRAWINGS

In referring to the drawings:

FIG. 8 shows the chart and calculations indicating the lesser force required through usage of the nozzle of this invention.

DESCRIPTION OF THE PREFERRED EMBODIMENT

Figure 1:
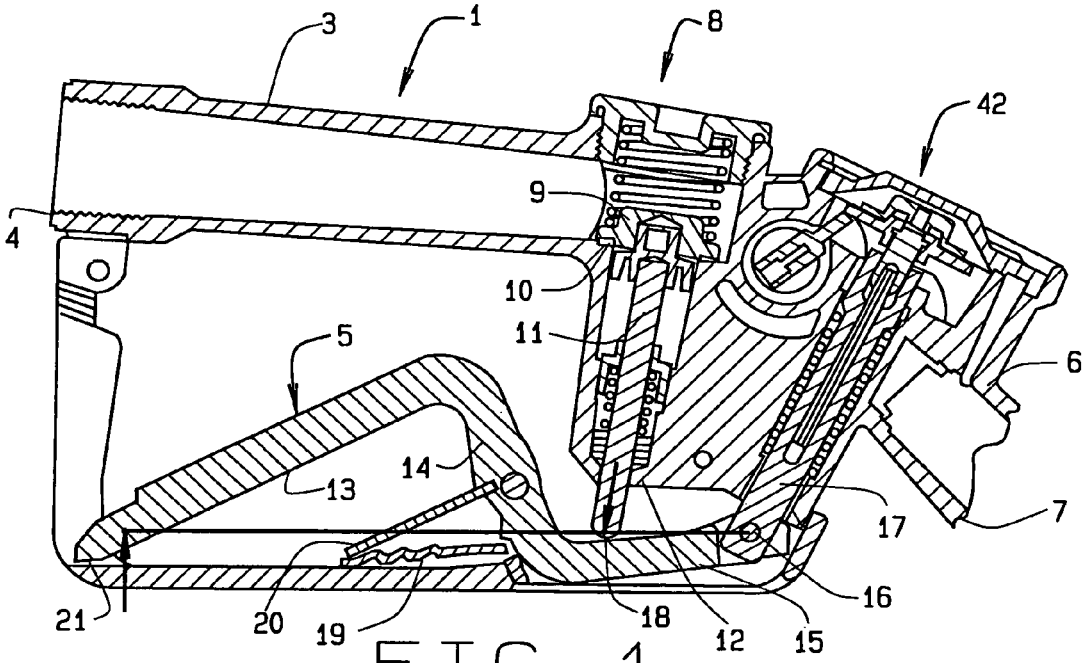
FIG. 1 PRIOR ART
FIG. 1 shows a sectional view of a prior art style of fuel dispensing nozzle.

In referring to the drawings, and in particular FIG. 1, therein is shown a prior art style of nozzle construction 1, which as known, includes a housing 3 having an inlet 4 and an outlet 6 generally at the location of the formation and location of the spout 7 to the nozzle. The nozzle includes a main valve 8 that includes a poppet valve 9 that rests upon a valve seat 10, with the poppet valve having a poppet stem 11 that extends downwardly through the nozzle body, as at 12. Usually, the handle lever 5 includes a hand gripping portion 13 which is configured in a rather S shape, having an intermediate portion 14 and a forwardly extending integral portion 15 that secures by a pinned connection, as at 16, to the bottom of the automatic shutoff stem 17 for the shown nozzle. Thus, when the handle lever 5 is elevated, it pushes the poppet stem 11 upwardly, at the location of 18, to provide for an opening of the poppet valve and the flow of fuel through the nozzle, for dispensing into a vehicle fuel tank (not shown). To retain the handle lever 5 in a opened position, a latch plate 19 engages with a lock plate 20 to maintain the handle in an opened condition, until such time as the handle lever is released from its latch plate connection, through the release of the lock plate 20, to allow the nozzle poppet valve to quickly enter into closure. This is normally achieved through the automatic shutoff means, in a manner as known in the art, being released, so that its stem 17 will abruptly drop, releasing the lock plate, to allow the handle to drop downwardly, allowing the poppet stem 11 to allow the poppet valve to enter into prompt closure, immediately shutting off any further fuel flow through the nozzle. As generally can be seen, with the location of the handle lever 5, that extends all the way integrally to its pinned connection, as at 16, with the shutoff stem 17, there is significant distance from the end of the hand lever, as at 21, to the pinned connection 16, and further distance between the pinned connection 16, to the bottom of the poppet stem, as at 18, so that the fulcrum for the handle lever to open the nozzle, against the pressure of the poppet spring, is significant, and as previously summarized, generally somewhere in the vicinity of 8-10 lbs, or more, of pressure that is required to open the hand lever for dispensing of gasoline.

Figure 2:
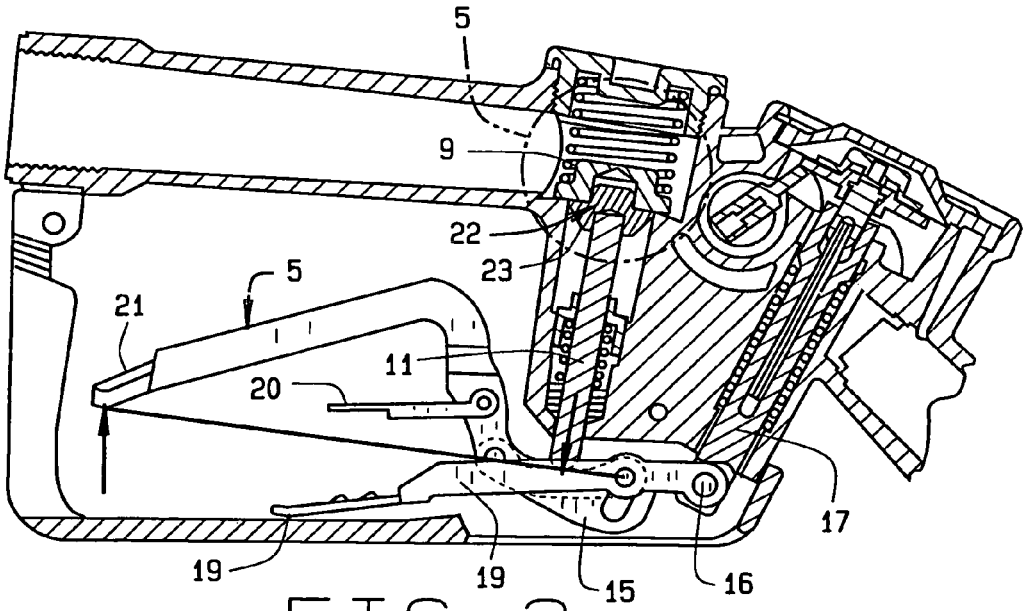
FIG. 2 shows a sectional view of the inventive nozzle of the current design.
Figure 5:
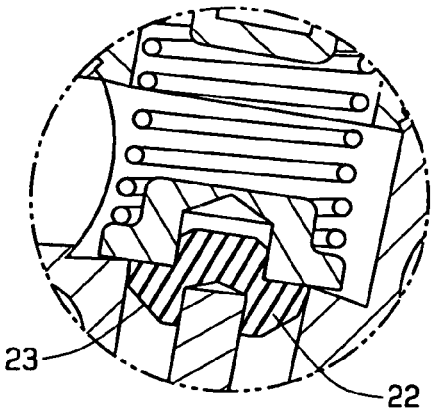
FIG. 5 shows the truncated gasket of the poppet valve of this invention, in closed position.
Figure 6:
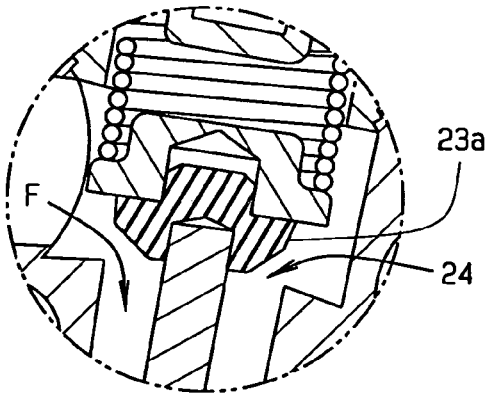
FIG. 6 shows the gasket of the poppet valve of this invention in its opened and fuel flowing condition.

One of the significant improvements of the current invention, as can be seen in FIGS. 2, 5 and 6, is the usage of a particular designed poppet valve gasket, as at 22, which is truncated of shape, having a downwardly sloping edge, as at 23, so that when the poppet valve is opened, as can be seen in FIG. 6, a much greater spacing, as at 24, is provided between said gasket and the valve seat, that allows for a more abundant flow of the fuel to pass through the nozzle, as at F, at the location of the poppet valve, to provide for a more accelerated flow of fuel through the nozzle, during dispensing. It can be seen how the gasket 22 and its downwardly sloping compound contoured surfaces 23 seat within the opening 24 of the nozzle, as noted in FIG. 5, where the poppet valve is shown in closure. Nevertheless, when opened, as noted in FIG. 6, it provides an abundant flow path through which the vehicle fuel can pass, through the nozzle, for accelerating the fill-up of the vehicle fuel tank, to which the nozzle is applied.

Figure 7:
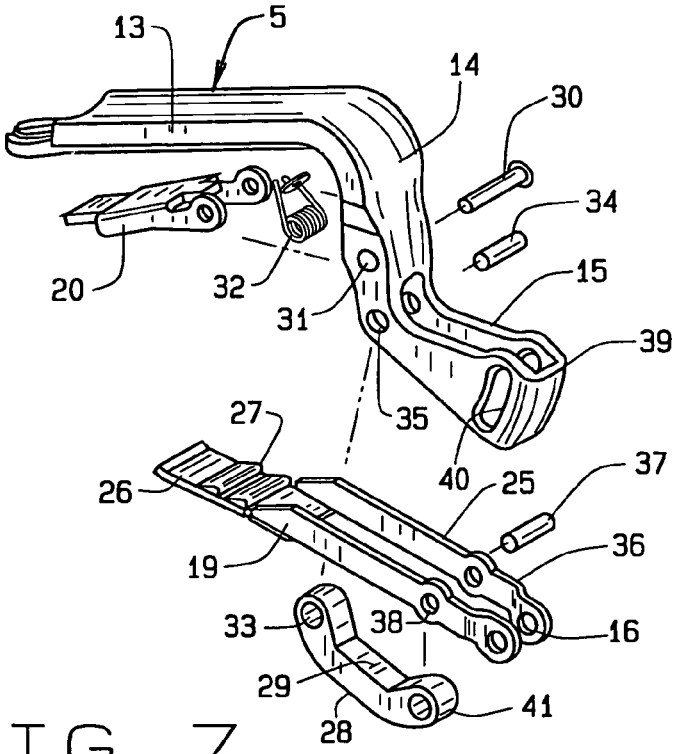
FIG. 7 discloses an exploded view of the various operative components of the hand lever and latch plate for the nozzle of this invention.

The hand lever mechanism and its associated components for this invention are disclosed in FIG. 7. The hand lever 5, with its hand gripping portion 13, is formed to the unique shape as further reviewed, having an intermediate portion 14 and a forwardly and integrally extending portion 15, as explained. The latch plate 19 can be seen, and it has a forwardly extending portion 25 and the rearwardly extending latch plate 26 which includes a series of ridges, as at 27, and into which the end of the lock plate 20 can temporarily engage, when the handle lever is raised to allow for automatic dispensing of fuel through the nozzle, and is held into an opened position, due to such engagement. The handle lever 5 further includes the handle link 28 whose upper surface 29 is what contacts the bottom of the poppet stem 11, to hold it into an opened condition, during fuel dispensing. The assembly of these various parts can be described as follows. The lock plate 20 is secured by means of the pivot pin 30 through the pin seat apertures 31 which also holds, within the handle, the biasing spring 32 which normally urges the lock plate to pivot upwardly, during normal disengagement of it from the latch plate 26. Thus, when the handle lever 5 is raised, the user of the nozzle must pivot the lock plate 20 downwardly, to engage it within the ridges 27 of the latch plate 19, to keep the poppet valve open, as can be understood.

The handle link 28 has an aperture 33 at one end, and it is secured for pivotal movement, by means of the pivot pin 34 seating within the apertures 35 of the hand lever. That allows for the link to pivot relative to the handle lever, as can be understood.

The opposite end of the latch plate 19 includes forwardly extending arms, as at 36, and these arms are secured to the pivot point 16 at the bottom of the automatic shutoff stem 17, to attain pivotal movement relative thereto.

Figure 3:
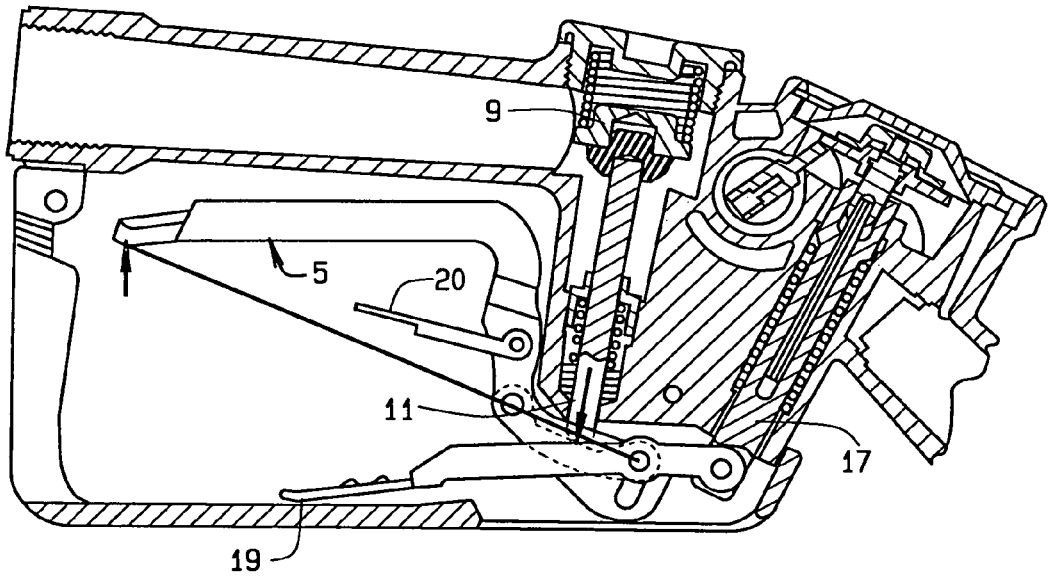
FIG. 3 shows the positioning of the operative components of the fuel dispensing nozzle of FIG. 2, while opened and dispensing fuel.
Figure 4:
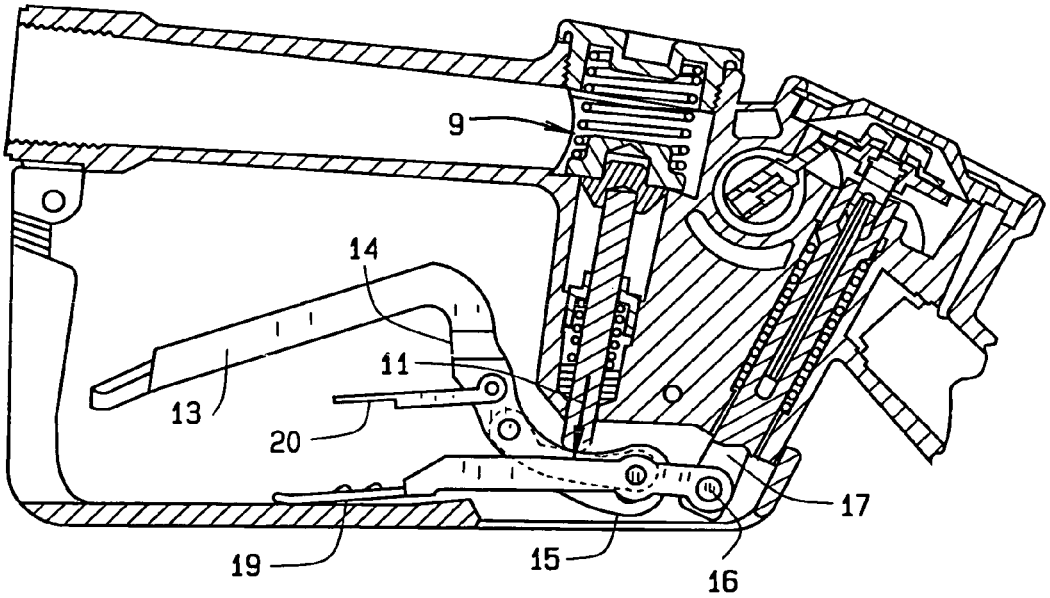
FIG. 4 discloses the fuel dispensing nozzle of this design, immediately after the automatic shutoff has initiated closure, and just before the poppet valve is shifted and dropped into a closed position.

The opposite end of the link 28 secures by the pin 37 through the latch plate apertures 38, and the pin arranges these arms to either side of the enlarged end 39, of the hand lever, with the pin extending also through the elongated slots 40 of said handle lever, as can be noted. Thus, when the handle lever is raised, its forward end 39 shifts downwardly, the front end of the link, as at 41, as pinned therein, shifts upwardly within the elongated slots 40, and since the shutoff stem 17 is secured in its upward position, as can be seen in FIG. 3, the link 28 biases against the poppet stem 11, raises it, opening the poppet valve, and its gasket 22 into an opened condition, during fuel flow. Thus, because of the slotted arrangement 40, within the hand lever, this shifts the length of the fulcrum of the contact of the valve stem 17 with the link, closer to the hand levers pivotal connection, as at 16, to the bottom of the shutoff stem 17. The shorter that distance, and the longer the distance between that pivotal point 16 to the end of the handle, increases the fulcrum power of the hand lever, when opening the nozzle, and provides for a lesser force requirement to attain the opening of the nozzle, than has heretofore been achieved in nozzle construction. As can be calculated through the various formulations provided within this disclosure, that lessening of force is approximately 50% less than the force usually required for opening the prior art style of nozzle (as in FIG. 1), and therefore, reduces that force below 5 lbs of pressure, which has been determined through research and experimentation. Such can also be calculated from the various formulations as identified and shown in the summary of this particular invention.

Then, when the automatic shutoff means 42 is rendered operative, as when fuel fills up the vehicle fuel tank, and the fuel blocks the tip end of the nozzle spout, the automatic shutoff means is actuated, provides for an immediate drop in its stem 17 to a lower position, which automatically releases the lock plate 20 from engagement with its latch plate 19, and allows the poppet valve 9 to drop with the valve stem 11, into closure, in the manner as shown in FIG. 5. Thus, as previously reviewed, the concept of this invention is to provide for a lesser force requirement to open the poppet valve, during its usage, and at the same time, to increase fuel flow, because of the unique shape and construction of its poppet valve, and the associated gasket, of the shown nozzle.

Variations or modifications to the subject matter of this invention may occur to those skilled in the art upon review of this invention, as described. Such variations, within the scope of this invention, are intended to be encompassed within the scope of any claims to patent protection issuing hereon. The description of the preferred embodiment, and its depiction in the drawings, are primarily set forth for illustrative purposes only.

I claim:

1. A nozzle construction to lessen the force required to open the nozzle for fuel flow while simultaneously accelerating the flow of fuel through the nozzle for dispensing into a vehicle, comprising:

a poppet valve provided within the nozzle and normally seating onto a valve seat to prevent the flow of fuel through said nozzle during non-usage, and when opened allowing for the flow of fuel through said nozzle, a gasket provided within the poppet valve and normally sealing upon said valve seat, said gasket being truncated in shape, a poppet stem, said poppet stem mounting said poppet valve, and said gasket, normally extending into said valve seat and upon a forced opening furnishing an enhanced flow of fuel through said nozzle, during dispensing;

a hand lever, said hand lever contacting the bottom of said poppet stem and when said hand lever is raised, lifting said poppet stem and gasket to allow said enhanced flow of fuel through the nozzle during fuel dispensing;

said gasket being truncated has a lesser diameter at its bottom than at its top, with a lesser diameter of said gasket fitting into the said valve seat, when securing the nozzle against fuel flow, said gasket being truncated has a compound slope, and said gasket being truncated is shaped at an approximate 30°-50° angle from the vertical of said poppet valve and its stem;

said nozzle includes an automatic shutoff, said hand lever cooperating with said poppet valve and its poppet stem to initiate the flow of fuel through said nozzle or to release said poppet valve and said poppet stem to shutoff fuel flow through said poppet valve, said hand lever also securing with the automatic shutoff to achieve closure of said poppet valve when the automatic shutoff detects a fuel filled vehicle;

said hand lever including a handle, a handle link at one end pivotally connecting to said handle, a latch plate, said handle link at its other end pivotally connecting with said latch plate, at the location of connection of said handle link to said latch plate said handle end having an elongated slot such that as the handle link pivots it also shifts along said elongated slot and thereby lessens the force necessary to lift the valve stem to shift the poppet valve into an opened position during fuel flow through said nozzle; and said latch plate at its front end pivotally connecting with the automatic shutoff, a lock plate pivotally connecting with said hand lever, and at its other end engaging with the opposite end of said latch plate to secure the nozzle into an opened and fuel flowing condition for dispensing of fuel.

2. The nozzle construction of claim 1 wherein the force necessary to open the poppet valve through manipulation of said handle is less than 5 lbs of pressure.

3. The nozzle construction of claim 2, wherein the lessening of force to pull the handle into a nozzle opened position can be determined initially through summation of the moments about the connection between the front of the latch plate with the automatic shutoff stem through calculations made from the following formulation:

Summation of moments about $P_1$ to break static equilibrium $$\circlearrowleft \sum M_{P_1} = 0_j F_{USER} \cdot X_2 - F_{STEM} \cdot X_1 = 0 \Rightarrow F_{USER}^{CURRENT} = \frac{X_1}{X_2} F_{STEM}$$

and then moving the force control to the front of the handle link and the summation of moments of force about that pivot point to attain calculations from the following formulation:

thereby providing for a determination of the reduction of force necessary to open the handle through calculations from the following formula:

Percent reduction in force experienced by the user is $F^{EZ_{user}}$ divided by $F^{Current_{user}}$ $$\%\ RED = \frac{(X_1 - d)}{(X_2 - d)} \cdot F_{STEM} \cdot \frac{X_2}{X_1 \cdot F_{STEM}} = \frac{(X_1 - d)}{(X_2 - d)} \cdot \frac{X_2}{X_1}$$

resulting in a force reduction of over 50% from the force required to open the standard poppet valve.

4. A nozzle construction to lessen the force required to open the nozzle for fuel flow while simultaneously accelerating the flow of fuel through the nozzle for dispensing into a vehicle, comprising;

a poppet valve provided within the nozzle and normally sealing onto a valve seat to prevent the flow of fuel through the nozzle during non usage, and when opened allowing for the flow of fuel through the nozzle, a gasket provided within the poppet valve and normally sealing upon said valve seat, a poppet stem, said poppet stem mounting said poppet valve and said gasket normally extending into said valve seat and upon a forced opening furnishing an enhanced flow of fuel through said nozzle, during dispensing;

a hand lever, said hand lever contacting the bottom of said poppet stem and when said hand lever is raised, lifting said poppet stem and gasket to allow said enhanced flow of fuel through the nozzle during fuel dispensing;

said nozzle including an automatic shutoff, said hand lever cooperating with said poppet valve and its poppet stem to initiate the flow of fuel through said nozzle or to release said poppet valve and said poppet stem to shutoff fuel flow through said poppet valve, and said hand lever also securing with the automatic shutoff to achieve closure of said poppet valve when the automatic shutoff detects a fuel filled vehicle;

said hand lever including a handle, a handle link at one end pivotally connecting to said handle, a latch plate, said handle link at its other end pivotally connecting to said latch plate, at the location of connection of said handle link to said latch plate, said handle end having an elongated slot such that as the handle link pivots it also shifts along said elongated slot and thereby lessen the force necessary to lift the valve stem to shift the poppet valve into an opened position during fuel flow through said nozzle;

said latch plate at its front end pivotally connecting with the automatic shutoff, a lock plate pivotally connecting with said hand lever, and at its other end engaging with the opposite end of said latch plate to secure the nozzle into an opened and fuel flowing condition for dispensing of fuel; and wherein the force necessary to open the poppet valve through manipulation of said handle is less than 5 lbs of pressure.

* * * * *